US005373270A

United States Patent [19]

Blair et al.

[11] Patent Number: 5,373,270

[45] Date of Patent: Dec. 13, 1994

[54] MULTI-CAVITY DIELECTRIC FILTER

[75] Inventors: William D. Blair, Lanoka Harbor; Salvatore Bentivenga, Parlin; Gregory J. Lamont, Jackson, all of N.J.

[73] Assignee: Radio Frequency Systems, Inc., Marlboro, N.J.

[21] Appl. No.: 163,154

[22] Filed: Dec. 6, 1993

[51] Int. Cl.[5] ..... H01P 1/20; H01P 7/10

[52] U.S. Cl. ..... 333/202; 333/219.1; 333/235

[58] Field of Search ..... 333/202, 208–212, 333/219, 219.1, 227–233, 235

[56] References Cited

U.S. PATENT DOCUMENTS

| | | | |
|---|---|---|---|
| 4,251,787 | 2/1981 | Young et al. | 333/209 |
| 4,862,122 | 8/1989 | Blair, Jr. et al. | 333/202 |
| 4,942,377 | 7/1990 | Ishikawa et al. | 333/202 |
| 5,051,714 | 9/1991 | Bentivenga et al. | 333/227 |
| 5,065,119 | 11/1991 | Jachowski | 333/202 |
| 5,083,102 | 1/1992 | Zaki et al. | 333/202 X |

*Primary Examiner*—Seungsook Ham

*Attorney, Agent, or Firm*—Ware, Fressola, Van Der Sluys & Adolphson

[57] ABSTRACT

A multi-cavity dielectric filter 30 having a single housing 32 for a plurality of resonant cavities 65. The dielectric filter 30 has a plurality of dielectric resonators 42 placed inside housing 32, instead of in individual housings, wherein the resonators 42 are spaced a quarter wave apart and are electrically isolated from one another by conductive isolation plates 44 positioned therebetween. The isolation plates 44 do not make continuous mechanical contact with the interior conducting surface of housing 32, but rather are spaced from the inner surface 77 of housing 32, thereby making assembly of the filter much simpler than if a solid RF connection had to be made. The resonators 42 are positioned inside the housing 32 between the isolation plates 44 and are supported by low loss, low dielectric constant spacers 46. End walls 59 complete the cavity formation at the termination ends 79 of housing 32. For a band reject filter, the cavities are joined by coupling loops connected to a transmission line while for a bandpass filter, apertures are placed in the isolation plates (44') so as to couple electromagnetic energy between adjacent cavities (65).

23 Claims, 8 Drawing Sheets

MULTI-CAVITY DIELECTRIC FILTER

BACKGROUND OF THE INVENTION

1. Field of the Invention

The present invention relates to electromagnetic filters and, more particularly, to improved multi-cavity dielectric filters for attenuating signals in the ultra-high frequency range.

2. Description of the Prior Art

Dielectric filters typically are used for filtering electromagnetic energy in the ultra-high frequency band, such as those used for cellular communications in the 800+ MHz frequency range. Band reject filters often comprise a plurality of dielectric notch resonators that are coupled to a transmission line by means of well-known coupling techniques. Bandpass filters also often comprise a plurality of dielectric resonators.

Representative of such filters are the filters shown in U.S. Pat. No. 4,862,122, entitled, "Dielectric Notch Filter", issued Aug. 29, 1989 and U.S. Pat. No. 5,065,119, entitled, "Narrow-Band, Band-Stop Filter", issued Nov. 12, 1991.

These filters are designed and manufactured having a plurality of dielectric resonators with each dielectric resonator having its own housing and each housing having top and bottom covers and cylindrical or rectangular sidewalls. Each housing serves to contain electromagnetic fields thereby preventing radiation losses that would lower the quality factor (Q) of the resonator. The Q is also related to the internal dimensions and the conductivity of each housing. The resonators in the case of notch filters are positioned along a transmission line at intervals of an odd multiple of a quarter wavelength as determined by the center of the filtering frequency. The transmission line serves to couple the resonators thereby producing the desired frequency response. In the bandpass case the resonators are usually proximity coupled, within input and output connectors and associated coupling loops rather than through use of a transmission line and associated coupling loops.

A shortcoming of these filters is that each resonator requires its own individual housing, thereby resulting in a less than optimum filter size and high material costs.

Although U.S. Pat. No. 5,051,714, entitled "Modular Resonant Cavity, Modular Dielectric Notch Resonator and Modular Dielectric Notch Filter", describes a modular dielectric notch filter, the overall housing comprises a plurality of individual shells 24 or 24' that are secured together by means of rods 42. The closure plates 26, 26' and 26'' securely mechanically interfit with the ends of the shells. There is no suggestion that the closure plates need not be securely mechanically interfitted to the shells, nor that the shells could be combined into a single housing. Furthermore, the disclosed orientation of resonators 48 would generate current flow in plates 26, thereby requiring a continuous mechanical (and therefore electrical) connection with shell 24.

It would be desirable to overcome the above-mentioned shortcoming of each resonator having its own individual housing. It would also be desirable to have a multi-cavity filter that is easier to fabricate than the multi-housing filter design shown in U.S. Pat. No. 5,051,714. Accordingly, an improved multi-cavity filter having a single housing for a plurality of dielectric resonators is disclosed herein.

SUMMARY OF THE INVENTION

The present invention discloses an improved multi-cavity dielectric filter having a single housing for a plurality of dielectric resonators. This dielectric filter has all of the dielectric resonators placed inside a single cylindrical housing instead of in individual housings, wherein the resonators are spaced approximately a quarter wave apart and are electrically isolated from one another by placing conductive walls therebetween. A unique feature is that the isolating plates need not make continuous electrical contact with the interior conducting surface of the surrounding cylindrical housing as is required in most instances when working with high Q resonators. The reason for this result is based upon the phenomenon that modes of resonance associated with such cavities, such as the $TE_{011}$ mode, generate electric and magnetic field orientations (E and H fields) that in theory produce no current flow in a conductive surface that is parallel to a flat surface of a dielectric resonator. By orienting the dielectric resonator within the cavity so that its flat surfaces are parallel to the isolation plates forming the end walls of the cavity, a high Q dielectric resonant cavity is achieved without the isolation plates making contact with the inside of the cylindrical housing except for electrical conduction provided by set screws used to position the isolation plates with respect to the cylindrical housing.

Thus since such continuous electrical contact is not required, the isolation plates can be spaced a small distance from the inside of the housing, thereby making assembly much simpler than if a solid RF connection had to be made. The isolation plates are therefore primarily held in position for mechanical reasons, although some electrical connection to the housing is required to minimize extraneous couplings between resonators which may occur due to unwanted modes of resonance and to form an electrical path for nominally induced currents.

The resonators are positioned and held inside the housing between the isolation plates and are supported by low loss, low dielectric constant spacers.

The dielectric filter is tuned by the use of conductive threaded rods that are brought into proximity to the dielectric resonators. Adjustment of each resonator is necessary as tolerances on the resonator and the housing dimensions all have some effect on frequency. Keeping the tuning to a minimum maintains high Q and frequency stability over temperature.

Each dielectric cavity in a notch filter is coupled to a transmission line so as to yield a desired filter operable over a desired frequency range. In a preferred configuration the resonators are stagger tuned so as to produce a response where a reject bandwidth is maximized at a particular attenuation level. The actual design of the line can follow several different approaches.

In a bandpass filter according to the present invention, coupling between cavities is achieved by apertures within the isolation plates. Input and output connectors with associated coupling means, such as coupling loops, allow electromagnetic energy to enter and leave the filter.

From the above descriptive summary, it is apparent how the multi-cavity dielectric filter according to the present invention overcomes the shortcoming of the above-mentioned prior art.

Accordingly, the primary objective of the present invention is to provide a multi-cavity dielectric filter for operating in the ultra-high frequency range and having a single housing for a plurality of dielectric resonators, with the cavities separated by isolation disks that do not make intimate contact with the housing but rather are positioned therein by means of set screws or the like.

Other objectives and advantages of the present invention will become apparent to those skilled in the art upon reading the following detailed description and claims, in conjunction with the accompanying drawings which are appended hereto.

BRIEF DESCRIPTION OF THE DRAWINGS

In order to facilitate a fuller understanding of the present invention, reference is now made to the appended drawings. These drawings should not be construed as limiting the present invention, but are intended to be exemplary only.

BEST MODE FOR CARRYING OUT THE INVENTION

Figure 1:
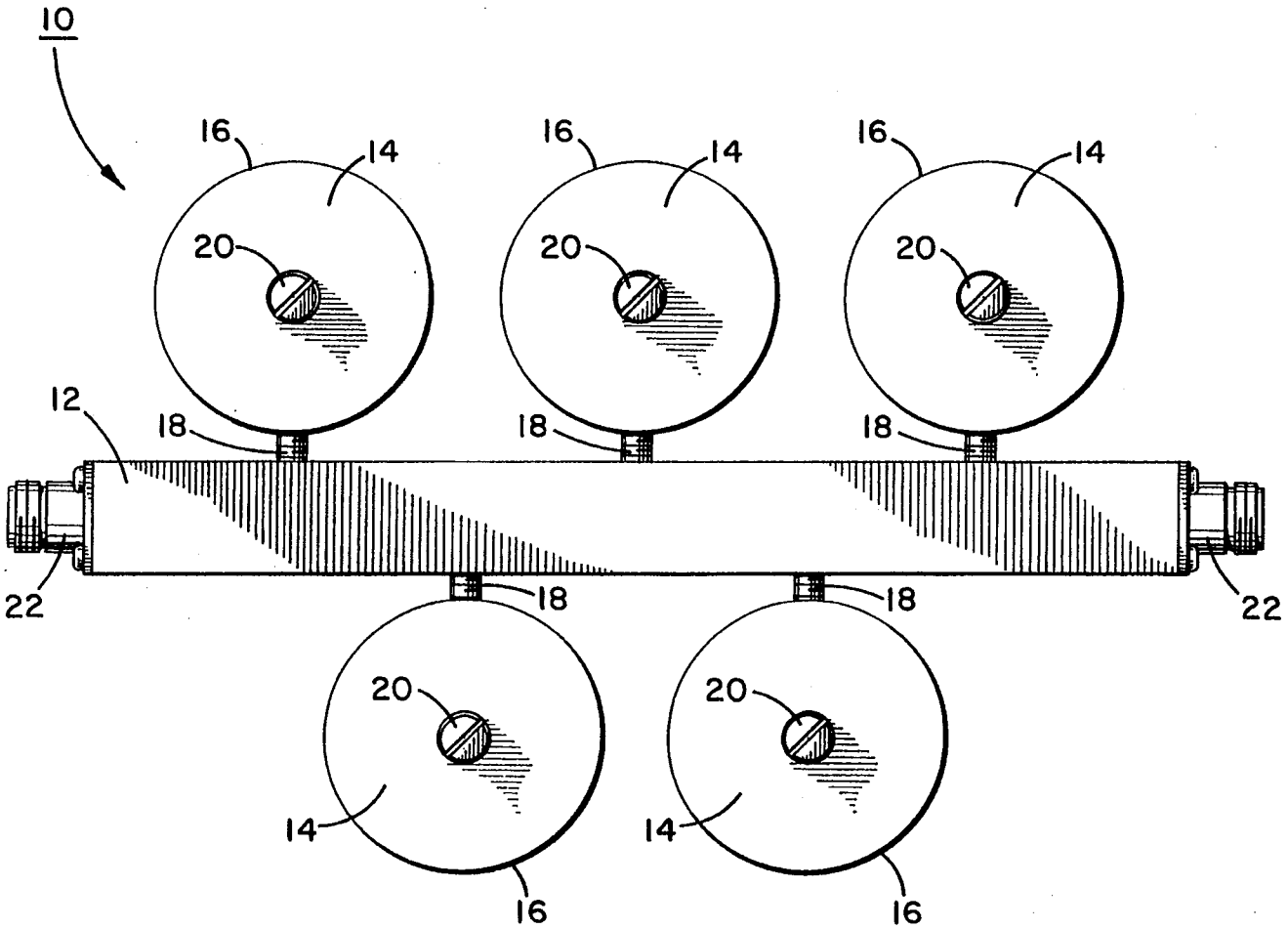
FIG. 1 (PRIOR ART)
FIG. 1 is a top view of a multi-cavity dielectric filter.

Referring to FIG. 1, there is shown a prior art multi-cavity dielectric filter 10 such as that disclosed in the above-referenced U.S. Pat. No. 4,862,122. This filter 10 comprises a transmission line 12 that is used to couple a plurality of dielectric resonator devices 14, each having its own cylindrical housing 16, so as to achieve a desired frequency response. Each resonator device 14 is electrically connected to the transmission line 12 via an electrical connector 18, with each electrical connector 18, and hence each resonator device 14, being displaced along the transmission line 12 at intervals of an odd multiple of a quarter wavelength as determined by the center of the filtering frequency. Each resonator device 14 is equipped with a tuning disk 20 for adjusting the frequency response of each resonator device 14. Both ends of the transmission line 12 are equipped with a connector 22 so as to provide an input and an output connection to and from the filter 10, respectively.

Figure 2:
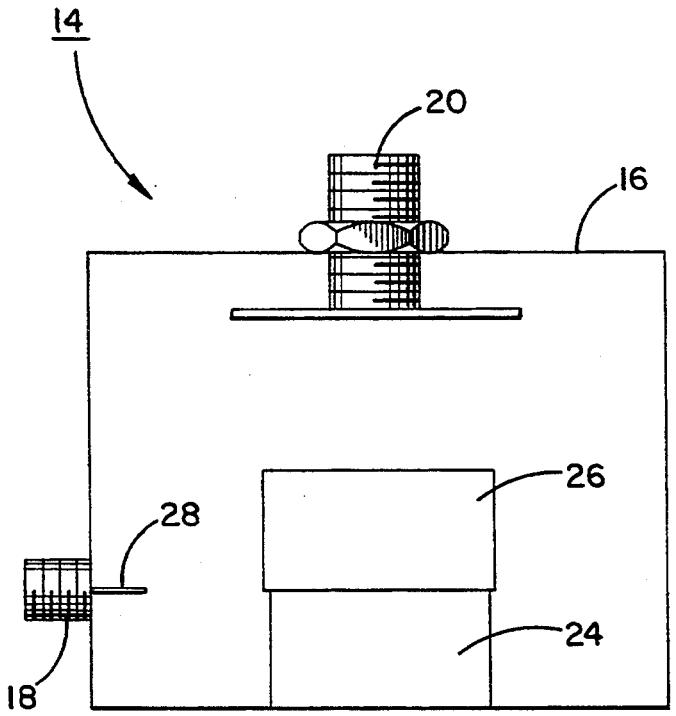
FIG. 2 (PRIOR ART)
FIG. 2 is a cross-sectional side view of one of the dielectric resonator housings shown in FIG. 1.

Referring to FIG. 2, there is shown a cross-sectional side view of one of the prior art resonator devices 14 shown in FIG. 1. Within the resonator housing 16, a low loss, low dielectric support 24 provides a foundation for a dielectric resonator 26. The resonator device 14 is coupled to the transmission line 12, and hence to the other resonator devices 14, via a coupling loop 28.

Figure 3:
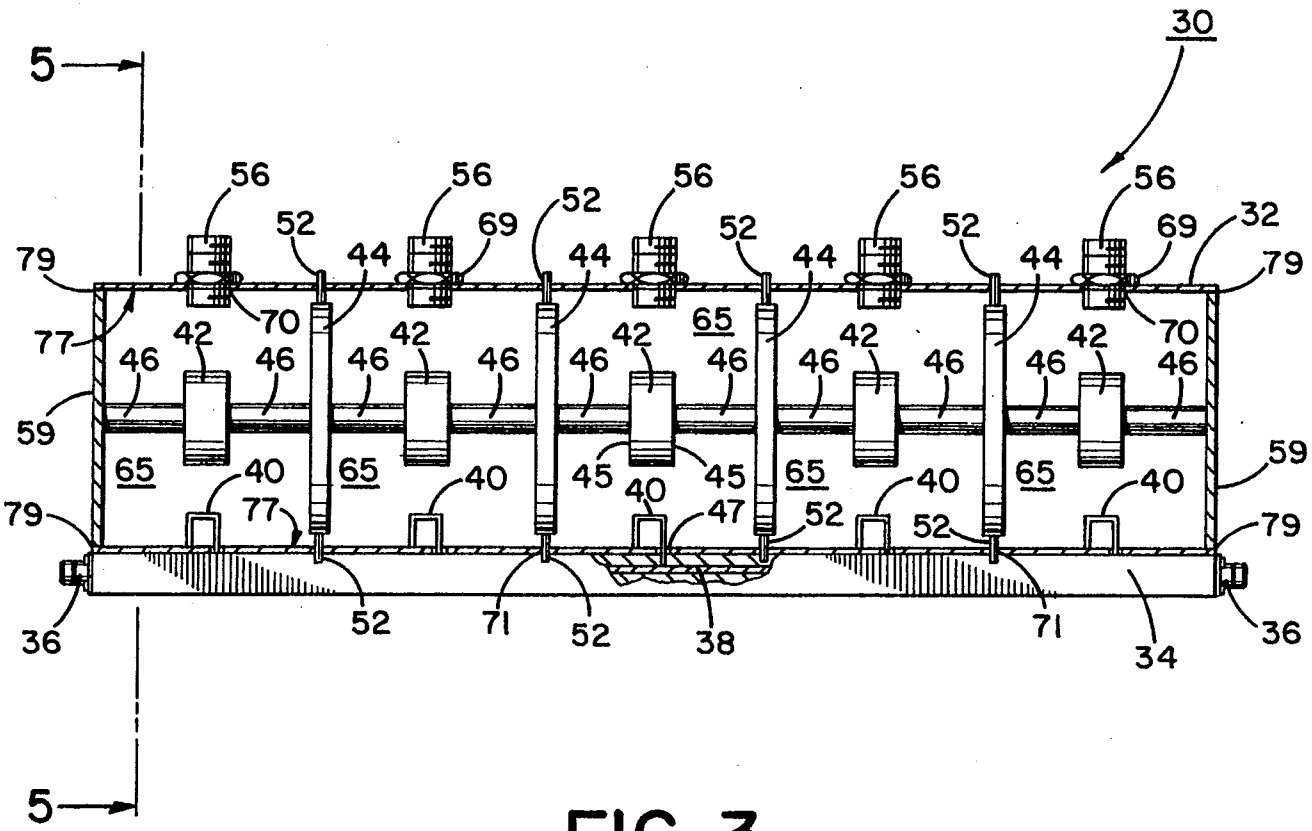
FIG. 3 is a partial cross-sectional side view of an improved multi-cavity dielectric filter according to the present invention, wherein the filter is configured as a band reject filter.

Referring to FIG. 3, there is shown an improved multi-cavity dielectric filter 30 according to the present invention that is configured as a band reject filter. This filter 30 comprises a single cylindrical housing 32 having a transmission line assembly housing 34 securely attached thereto. Within housing 32 are a plurality of isolation plates 44, that together with end walls 59 define a plurality of cavities 65. For the preferred embodiment shown, the housing 32 is cylindrical in shape and the plates are disk-shaped, with the diameter of each plate less than the inside diameter of cylindrical housing 32 and are therefore easily positioned within housing 32. The end walls 59 are also circular in shape and make continuous contact with the terminating periphery of housing 32. The cylindrical housing, isolation plates, and transmission line assembly housing are fabricated from electrically conductive material, such as aluminum.

Although the preferred embodiment illustrates a cylindrical housing with isolation plates and end walls that are in the form of disks, the housing can be constructed from a square or rectangular cross-sectional hollow member, or any other shape that provides electromagnetic modes of resonance. The isolation plates and end walls would conform to the shape of the housing with the isolation plates being smaller in size than the corresponding interior of the housing at which it is to be positioned.

Figure 3A:
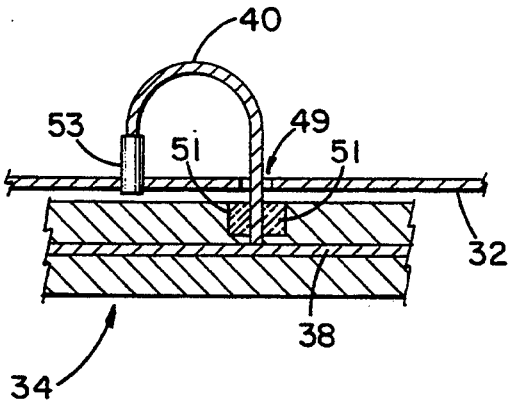
FIG. 3A is an enlarged view of a coupling loop and its termination, showing its termination with a series capacitor.

As seen in FIGS. 3 and 3A, the transmission line assembly housing 34, typically having a square or a rectangular cross-sectional construction, is equipped with a connector 36 at both ends so as to provide an input and an output connection to and from the filter 30, respectively. Extending through the transmission line assembly housing 34 between each connector 36 is a center conductor 38 to which one end of each of a plurality of coupling loops 40 are electrically connected. The spacing between where each coupling loop 40 is connected to the center conductor 38 is approximately a quarter wavelength as determined by the center of the filtering frequency. For example, with a center filtering frequency of 845.75 MHz, the spacing between where each coupling loop 40 is connected to the center conductor 38 is 2.9 inches (7.4 cm). The other end of each of the plurality of coupling loops 40 is electrically connected to the inside wall of the resonator housing 32, oftentimes through a corresponding plurality of terminating capacitors 53 (FIG. 3A).

The coupling loop passes through an orifice 47 in cylindrical housing 32. A bore 49 in the outer portion of transmission line assembly housing 34 provides a passageway for coupling loop 40. This bore may comprise a dielectric sheath 51 of a coaxial cable through which the coupling loop passes. The coupling loop may be soldered to center conductor 38. The other end of the coupling loop may be soldered to cylindrical housing 32, as shown in the alternative termination embodiment of FIG. 3A, or it may terminate at a series connected capacitor 53 that in turn is electrically connected to housing 32. The coupling loop 40 may have sharp turns as shown in FIG. 3 or may have smooth curves as shown in FIG. 3A.

It should be noted that the center conductor 38 and the coupling loops 40 are preferably fabricated of copper, although other conductive materials may also be used. It should also be noted that the transmission line typically has a characteristic impedance of 50 Ω. Although a specific transmission line design has been described, there are several other transmission line design techniques that may be followed.

Figure 4:
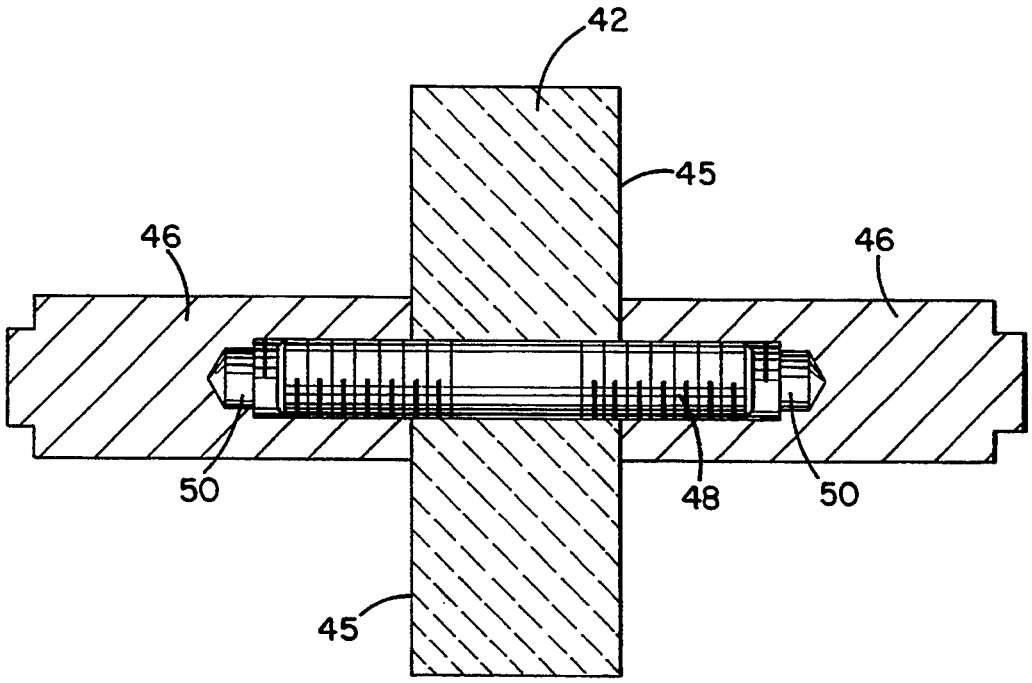
FIG. 4 is a cross-sectional side view of one of the dielectric resonators and supports shown in FIG. 3.

Within the cylindrical housing 32, a plurality of low loss, high dielectric constant resonators 42 are successively positioned corresponding to the position of an associated coupling loop 40, with each adjacent resonator 42 being electrically isolated from one another by a conductive isolation plate 44. As seen in FIG. 4, the dielectric resonators 42 are secured in their positions with low loss, low dielectric constant support elements 46 that provide spacing between the resonators 42, the isolation plates 44, and the end walls 59 of the resonator housing 32. End walls 59 are secured to the termination ends 79 of housing 32.

Referring to FIG. 4, there is shown a cross-sectional side view of one of the dielectric resonators 42 and its associated support elements 46. A screw 48, which is threaded at both ends, passes through the center of the resonator 42 and terminates within interior recesses 50 of the support elements 46. The interior recesses 50 of the support elements 46 are threaded so as to engage with the screw 48. The outer end of each support element 46 is molded or shaped to mate with a corresponding indentation or perforation 43 (see FIG. 7) in the isolation plate 44 or the end walls of the resonator housing 32. When the entire multi-cavity dielectric filter 30 is assembled, the stack comprised of all the dielectric resonators 42, isolation plates 44, and support elements 46 is force fit between end walls 59 of the housing 32. The end walls make a continuous mechanical and electrical connection to cylindrical housing 32. At this point it should be noted that the dielectric resonators 42 are fabricated of ceramic and the support elements 46 are fabricated of polyethylene. The screw 48 is fabricated of polysulfone, although other plastic materials may also be used.

Figure 5:
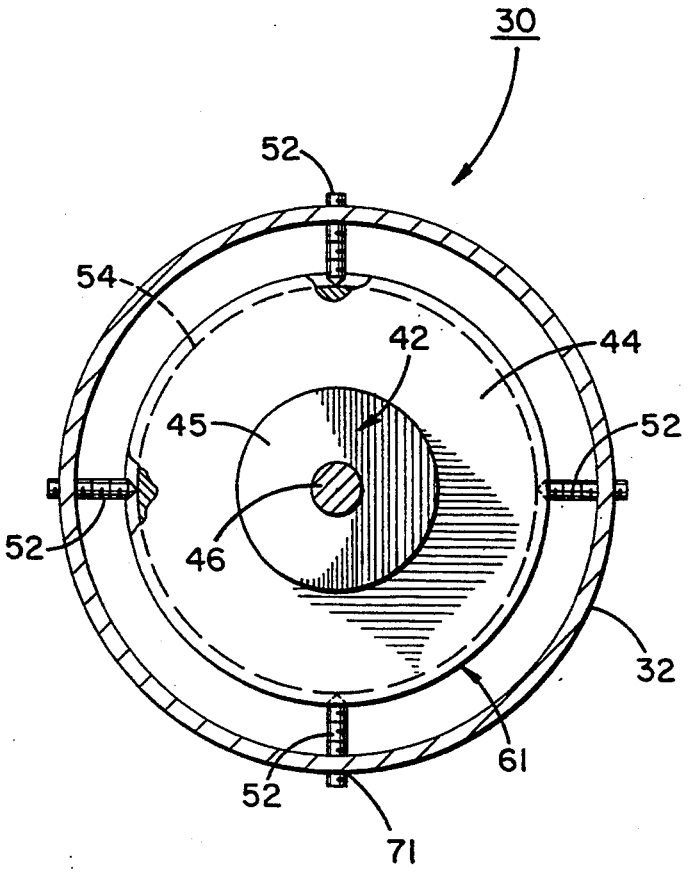
FIG. 5 is a cross-sectional end view of the improved multi-cavity dielectric filter shown in FIG. 3 taken along line 5—5 of FIG. 3.
Figure 8:
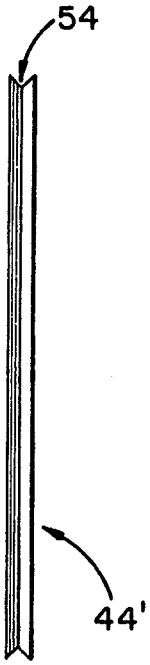
FIG. 8 is a side view of the isolation plate shown in FIG. 7, taken along lines 8—8 in FIG. 7, the side view also corresponding to a side view of the isolation plate shown in FIGS. 1 and 3.

Referring to FIG. 5, there is shown a cross-sectional end view of the improved multi-cavity dielectric filter 30. From this view it can be seen that the isolation plates 44 are secured in their positions with four set screws 52 which are tightened against the outer periphery 61 of each isolation plate 44. To insure that the isolation plate 44 maintains its axial position with respect to the set screws 52, the isolation plate preferably has a V-shaped peripheral groove 54 as best seen in FIG. 8. Other methods of securing the set screw could, of course, be used, such as indentations in the outer periphery 61 of the isolation plate at locations where the set screws will contact the isolation plate. The set screws pass through threaded holes 71 in housing 32. The set screws 52 are typically fabricated of steel, although other conductive materials may also be used.

Although the plates are shown in FIGS. 3 and 5 as not directly contacting the inner surface 77 of housing 32, each plate could be positioned to make some direct contact with the housing inner surface provided that the plate is able to be freely positioned within the housing. Thus the plate, when in the shape of a disk as shown in FIGS. 3 and 5, could contact the housing inner surface at one point with two or more set screws holding the disk in position at other points along its periphery.

As previously described, a unique feature of the improved multi-cavity dielectric filter 30 is that the isolation plates 44 do not have to make continuous mechanical and therefore electrical contact with the interior conducting surfaces of the resonator housing 32, as is the case with most high Q resonant cavity filters. Some electrical contact to the housing 32 is required to minimize extraneous couplings between adjacent cavities resonators 42 which may occur due to unwanted resonance modes. This minimal electrical contact is provided by the set screws 52. Since continuous peripheral electrical contact is not required, the isolation plates 44 may be spaced a small distance from the inside surface of the resonator housing 32 as best seen in FIG. 5, thereby making assembly much simpler than if a continuous peripheral solid RF connection had to be made.

The reason for this result is based upon the phenomenon that modes of resonance associated with such cavities, such as the $TE_{011}$ mode, generate electric and magnetic field orientations (E and H fields) that in theory produce no current flow in a conductive surface that is parallel to a flat surface of a dielectric resonator. By orienting the dielectric resonator within the cavity so that its flat surfaces 45 are parallel to the isolation plates (and end walls 59) forming the cavity 65 with the corresponding portion of housing 32, a high Q dielectric resonant cavity is achieved without the isolation plates making contact with the inside of the cylindrical housing except for electrical conduction provided by the set screws used to position the isolation plate with respect to the cylindrical housing. Such an orientation is achieved between isolation plates 44 and flat surfaces 45 of dielectric resonators 42. This technique also allows the commonly used method of disk tuning of dielectric resonators 42 to be employed without substantially degrading the performance of the filter 30.

Referring again to FIG. 3, the improved multi-cavity dielectric filter 30 may be fine tuned with a plurality of conductive threaded solid rods or tuning slugs 56, corresponding to the plurality of dielectric resonators 42, each having a diameter approximately equal to the thickness of the resonators 42. The rods pass through threaded holes 70 in housing 32 and are typically captured in position by nuts 69. Each of the plurality of conductive threaded rods 56 is positioned so as to be moveable in and out of close proximity to an associated one of the plurality of dielectric resonators 42, thereby adjusting the center frequency of that particular resonator 42. Adjustment of each resonator 42 is typically required as the tolerances on the resonator and the housing dimensions all have some effect on frequency. Keeping the tuning to a minimum maintains high Q and frequency stability over temperature. Such filter tuning is common in the art. It should be noted that the tuning rods 56 are preferably fabricated of brass, although other conductive materials may also be used.

Figure 6:
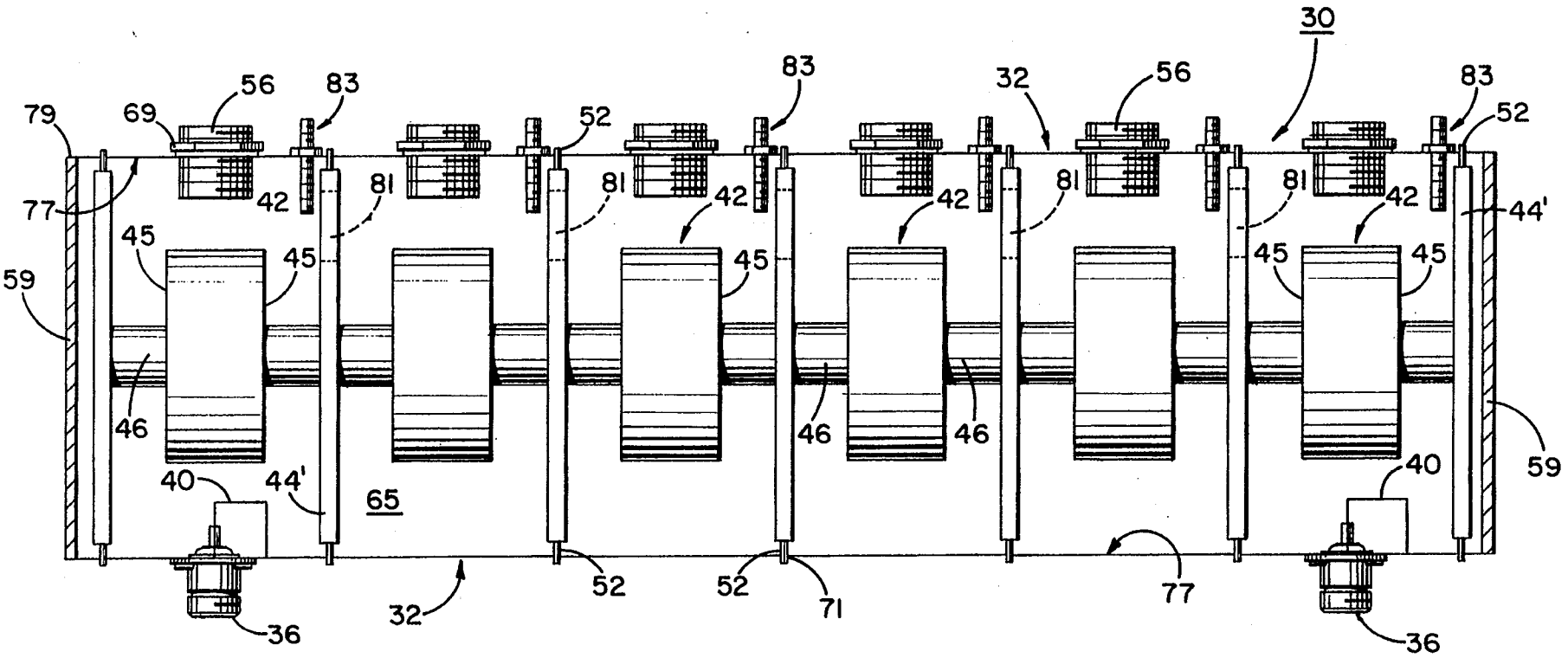
FIG. 6 is a partial cross-sectional side view of an improved multi-cavity dielectric filter according to the present invention, wherein the filter is configured as a bandpass filter.
Figure 7:
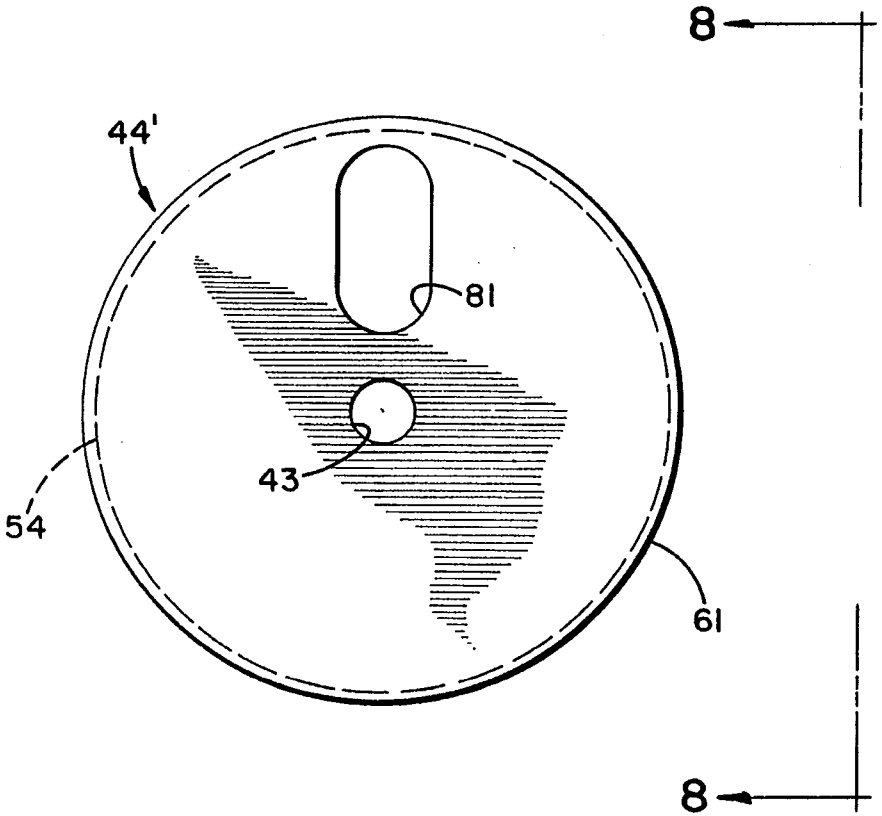
FIG. 7 is a plan view of an isolation plate used in the filter shown in FIG. 6.

FIGS. 6, 7 and 8 illustrate an alternative embodiment of the improved multicavity dielectric filter 30 which is configured as a bandpass filter. Elements that are the same or similar to the band reject filter shown in FIGS. 1–5 are identified with corresponding reference numerals. Thus, a plurality of cavities 65 are formed within housing 32 by means of end walls 59 and isolation plates 44'. Within each cavity is a dielectric resonator 42 and low dielectric constant support elements 46 for positioning the dielectric resonator within the housing. Electromagnetic energy is inserted into and output from the overall filter by means of connectors 36 and associated coupling loops 40. As best seen in FIGS. 7 and 8, the outer periphery of each isolation plate 44' incorporates a peripheral groove 54 extending along the outer periphery 61 of the isolation plate. Thus set screws 52 as shown in FIG. 6, position each of the isolation plates within the housing 32 so as to form cavities 65 therebetween.

Thus, the dielectric bandpass filter shown in FIGS. 6 through 8 is fabricated in a manner similar to the multi-cavity band reject filter shown in FIGS. 1–5. The primary difference is that for a bandpass filter, the dielectric resonators 42 are coupled to one another by allowing the electromagnetic fields generated within each individual cavity 65, to be coupled to the field in the adjacent cavity by an aperture 81 formed within each isolation plate 44'. The size and location of the aperture controls the amount of coupling. Further adjustment of the coupling is accomplished by means of screw 83 which protrudes into the cavity so as to essentially decrease the area of aperture 81 and thereby modify the respective coupling between adjacent cavities 65.

The size of the aperture in each of the isolation plates may vary, depending upon the particular amount of coupling required to produce a particular frequency response for a desired filter. Such coupling is thoroughly described in many filter handbooks,such as *Microwave Filters, Impedance-Matching Networks, and Coupling Structures* by G. Matthaei et al (Artech House Books, Dedham, Mass., Copyright 1980). In addition, the size and shape of coupling loop 40 is such as to provide the necessary coupling to achieve the desired overall frequency response of the filter in conjunction with the inter-resonator couplings via apertures 81 and isolation disks 44'.

With the preferred embodiments of the improved multi-cavity dielectric notch filter 30 now fully described, it can thus be seen that the primary objective set forth above is efficiently attained and, since certain changes may be made in the above described filter 30 without departing from the scope of the invention, it is intended that all matter contained in the above description or shown in the accompanying drawings shall be interpreted as illustrative and not in a limiting sense.

What is claimed is:

1. An improved multi-cavity dielectric filter (30) for operation within a predetermined filtering band comprising:

(A) a housing (32) having an electrically conductive inner surface (77) and two termination end regions (79);

(B) coupling means (36, 40), having input and output connectors (36) for coupling electromagnetic energy into and out from said filter; and (C) a plurality of dielectric resonator cavities (65) comprising:

(1) a plurality of dielectric resonators (42) having a pair of parallel flat surfaces (45), each resonator positioned within said housing (32);

(2) an electrically conductive isolation plate (44, 44') disposed between each adjacent pair of dielectric resonators (42), so as to be substantially parallel to one flat surface (45) of each adjacent resonator, for establishing a resonant cavity and for providing an amount of coupling of electromagnetic energy between cavities, said amount ranging from near zero to a predetermined amount, each isolation plate having an outer periphery less than the corresponding inner surface (77) of the housing (32);

(3) means (52) for securing each isolation plate (44, 44') within the housing (32) so that for each isolation plate, its corresponding outer periphery (61) is, at least throughout most of its peripheral path, spaced away from the inner surface (77) of the housing (32) and (4) end walls (59) connected to the termination end regions (79) of the housing.

2. An improved multi-cavity dielectric filter as defined in claim 1, wherein the means for securing each isolation plate (44, 44') within the housing (32) comprises a plurality of set screws (52), wherein the housing has a corresponding plurality of threaded holes (71) passing therethrough for receipt of said set screws, and wherein each isolation plate has a V-shaped peripheral groove (54) formed in its outer periphery (61) for engaging with said set screws.

3. An improved multi-cavity dielectric filter as defined in claim 2, wherein said set screws (52) are fabricated from an electrically conductive material.

4. An improved multi-cavity dielectric filter as defined in claim 2, wherein said housing (32) is cylindrical in shape and wherein said isolation plates (44, 44') and end walls (59) are disk-shaped.

5. An improved multi-cavity dielectric filter as defined in claim 1, wherein the filter is a bandpass filter and wherein each isolation plate (44') adjacent two cavities includes an aperture (81) through the plate that couples electromagnetic energy between the adjacent cavities.

6. An improved multi-cavity dielectric filter as defined in claim 5, wherein the amount of electromagnetic coupling between adjacent cavities is adjustable by a screw (83) in juxtaposed spaced relationship to the aperture (81) in the corresponding isolation plate (44).

7. An improved multi-cavity dielectric filter as defined in claim 5, wherein the coupling means includes a coupling loop connected at one end to one of the connectors (36) and connected at its other end to the housing (32) within one of the cavities (65).

8. An improved multi-cavity dielectric filter (30) as defined in claim 1, further comprising a plurality of electrically conductive tuning slugs (56) extending through holes (70) in said housing (32), the location of each of said plurality of tuning slugs (56) corresponding to the location of an associated one of said plurality of dielectric resonators (42).

9. An improved multi-cavity dielectric filter (30) as defined in claim 8, wherein said plurality of electrically conductive tuning slugs (56) are fabricated of brass.

10. An improved multi-cavity dielectric filter (30) as defined in claim 1, wherein said housing (32) is fabricated of aluminum.

11. An improved multi-cavity dielectric filter as defined in claim 1, wherein the filter is a band reject filter and wherein the coupling means comprises a transmission line (34) connected to the input and output connectors, and wherein the coupling means electrically couples the transmission line to the housing (32) at a plurality of odd quarter wavelength locations as determined by the center of a predetermined filtering band, and further wherein each dielectric resonator (42) is positioned within said housing (32) so as to be adjacent said coupling means at one of said plurality of odd quarter wavelength locations.

12. An improved multi-cavity dielectric filter (30) as defined in claim 11, wherein said transmission line means (34) is a coupling transmission line (34), that has a characteristic impedance of 50 Ω.

13. An improved multi-cavity dielectric filter (30) as defined in claim 11, wherein said coupling means (40) is a plurality of coupling loops (40), wherein each of said plurality of coupling loops (40) are electrically connected to the electrically conductive inner surface of said housing (32) at a first end and electrically connected to said transmission line means (34) at a second end.

14. An improved multi-cavity dielectric filter (30) as defined in claim 13, wherein said coupling means (40) further comprises a capacitor (53) connected in series to one end of the coupling loop (40), with the other end of the capacitor connected to the housing (32), and further wherein the coupling means includes a portion of circular coaxial dielectric material (51) positioned within the transmission line means (34), through which the other end of the coupling loop passes.

15. An improved multi-cavity dielectric filter as defined in claim 11, wherein said housing (32) is cylindrical in shape and wherein said isolation plates (44) are non-apertured and wherein the end walls (59) are disk-shaped.

16. An improved multi-cavity dielectric filter (30) as defined in claim 1, wherein said plurality of dielectric resonators (42) are fabricated from a low loss, high dielectric constant material.

17. An improved multi-cavity dielectric filter (30) as defined in claim 1, wherein each resonator is positioned within the housing by a support element (46) disposed between adjacent isolation plates (44) or between an adjacent isolation plate (44) and an end wall (59).

18. An improved multi-cavity dielectric filter (30) as defined in claim 17, wherein a first end of said at least one support element (46) is shaped to mate with a corresponding indentation or perforation formed in each isolation plate (44) and in each of said end walls (59) of said housing (32).

19. An improved multi-cavity dielectric filter (30) for operation within a predetermined filtering band comprising:

(A) a cylindrical housing (32) having an electrically conductive inner surface (77) and two termination end regions (79);

(B) transmission line means (34) having input and output connections (36) for allowing electromagnetic energy to be applied thereto and retrieved therefrom;

(C) electrically conductive coupling means (40) for electrically coupling said transmission line means (34) to said housing (32) at a plurality of odd quarter wavelength locations as determined by the center of a predetermined filtering band; and (D) a plurality of dielectric resonator cavities (65) comprising:

(1) a plurality of dielectric resonators (42) having a pair of parallel flat surfaces (45), each resonator positioned within said housing (32), adjacent to said coupling means (40) at one of said plurality of odd quarter wavelength locations;

(2) an electrically conductive isolation disk (44) disposed between each adjacent pair of dielectric resonators (42), so as to be substantially parallel to one flat surface (45) of each adjacent resonator, for providing electrical isolation between each of said adjacent dielectric resonators (42), each isolation disk having an outer periphery less than the corresponding inner surface (77) of the housing (32);

(3) means (52) for securing each isolation disk (44) within the housing (32) so that the outer periphery (61) of each isolation disk is spaced away from the corresponding inner surface (77) of the housing; and (4) end walls (59) connected to the termination end regions (79) of the housing.

20. An improved multi-cavity filter as defined in claim 19, wherein the means for securing each isolation plate (44) within the housing (32) comprises a plurality of set screws (52), wherein the housing has a corresponding plurality of threaded holes (71) passing therethrough for receipt of said set screws, and wherein each isolation plate has a V-shaped peripheral groove (54) formed in its outer periphery (61) for engaging with said set screws.

21. An improved multi-cavity dielectric filter (30) as defined in claim 20, further comprising a plurality of electrically conductive tuning slugs (56) extending through holes (70) in said housing (32), the location of each of said plurality of tuning rods (56) corresponding to the location of an associated one of said plurality of dielectric resonators (42).

22. An improved multi-cavity dielectric filter (30) as defined in claim 21, wherein said electrically conductive coupling means (40) is a plurality of coupling loops (40), wherein each of said plurality of coupling loops (40) are electrically connected to the electrically conductive inner surface of said housing (32) at a first end and electrically connected to said transmission line means (34) at a second end.

23. An improved multi-cavity dielectric filter (30) as defined in claim 22, wherein said electrically conductive coupling means (40) further comprises a capacitor (53) connected in series to one end of the coupling loop (40), with the other end of the capacitor connected to the housing, and further wherein the coupling means includes a portion of circular coaxial dielectric material (51) positioned within the transmission line means (34), through which the other end of the coupling loop passes.

* * * * *